US005342446A

United States Patent [19]

Jongsma et al.

[11] Patent Number: 5,342,446

[45] Date of Patent: Aug. 30, 1994

[54] APPARATUS FOR COATING A CONTINUOUS WEB

[75] Inventors: Ronald Jongsma, Spencerport; Larry R. Lammes, Rochester; Gifford J. Lewis, Rochester; Robert A. Wahlers, Rochester, all of N.Y.

[73] Assignee: Eastman Kodak Company, Rochester, N.Y.

[21] Appl. No.: 3,215

[22] Filed: Jan. 8, 1993

Related U.S. Application Data

[63] Continuation of Ser. No. 703,447, May 21, 1991, abandoned.

[51] Int. Cl.[5] ..... B05C 9/12; B05C 15/00; F26B 21/08

[52] U.S. Cl. ..... 118/65; 118/67; 118/69; 118/672; 34/65; 427/398.1; 427/398.5

[58] Field of Search ..... 118/58, 64, 65, 66, 118/67, 672, 68, 69; 427/398.1, 398.5; 34/65

[56] References Cited

U.S. PATENT DOCUMENTS

| | | | |
|---|---|---|---|
| 1,699,349 | 1/1929 | Bailey | 430/935 |
| 1,765,778 | 6/1930 | Schutte | 427/398.5 |
| 1,930,601 | 10/1933 | Townsend | 118/67 |
| 2,168,051 | 8/1939 | Smith et al. | 430/935 |
| 2,237,256 | 4/1941 | Finnegan | 62/65 |
| 2,269,169 | 1/1942 | Van Derhoef et al. | 118/67 |
| 2,365,352 | 12/1944 | Moffit | 62/168 |
| 2,620,285 | 12/1952 | Rose | 43/935 |
| 2,889,806 | 6/1959 | Conant | 118/69 |
| 3,029,778 | 4/1962 | Kaplan et al. | 118/67 |
| 3,136,652 | 6/1964 | Bicknell | 118/69 |
| 3,222,895 | 12/1965 | Sheppard | 118/67 |
| 3,635,193 | 1/1972 | Stease | 118/63 |
| 3,754,960 | 8/1973 | Hart, Jr. | 427/398.5 |
| 3,782,995 | 1/1974 | Takimoto et al. | 427/374.1 |
| 3,864,931 | 2/1975 | Guttinger | 62/63 |
| 4,158,070 | 6/1979 | Lewicki, Jr. et al. | 427/8 |
| 4,415,610 | 11/1983 | Choinski | 427/372.2 |
| 4,531,373 | 7/1985 | Rubinsky | 62/63 |
| 4,963,400 | 10/1993 | Bibbee et al. | 118/64 X |
| 5,041,312 | 8/1993 | Swartz | 118/326 |

FOREIGN PATENT DOCUMENTS

| | | |
|---|---|---|
| 2330130 | 11/1975 | France . |
| 60-83814A | 5/1985 | Japan . |
| 60-58938 | 9/1986 | Japan . |
| 640748 | of 0000 | United Kingdom . |
| 2167703A | 12/1984 | United Kingdom . |

*Primary Examiner*—Michael W. Ball
*Assistant Examiner*—Francis J. Lorin
*Attorney, Agent, or Firm*—Carl F. Ruoff

[57] ABSTRACT

Apparatus and method for coating a continuous web, such as paper or transparent film of cellulose acetate or polyethylene terephthalate, with liquid materials, such as photographic layer materials, which require chilling before they are dried, are described. Immediately before the chilling zone, the web with liquid materials thereon passes through isolation means which displaces higher dew point air travelling with the web with air having a dew point below the temperature of the atmosphere in the upstream end of the chilling zone. The displacement is achieved by directing several flows of low dew point air at the web. The flows are extensive transversely of the web and are spaced apart longitudinally of the web. Air may flow away from the web between the flows towards the web. By ensuring that the dew point of the air travelling with the web into the chilling zone is below the temperature in the upstream end of the chilling zone, condensation is avoided. Further, it becomes possible to operate at least the upstream end of the chilling zone at lower temperatures than previously. The flows of air onto the liquid coating are of such low velocity that the uniformity of thickness of the coating is not disturbed.

4 Claims, 4 Drawing Sheets

APPARATUS FOR COATING A CONTINUOUS WEB

This is a continuation of application Ser. No. 703,447, filed May 21, 1991, abandoned.

BACKGROUND OF THE INVENTION

1. Field of the Invention

This invention relates to the manufacture of coated sheet material, such as, for example, photographic film or paper.

2. Description of the Prior Art

It is known to manufacture photographic film or paper by coating a continuous web of a transparent film formed of, for example, cellulose acetate or polyethylene terephthalate, or of paper, with materials in liquid form. As is known, the liquid materials may include gelatin and silver halides. After the liquid materials have been coated on the web they have to be dried so that the coated web can be wound up into a roll. It is known to chill the liquid materials prior to commencement of drying, in order to set them. By having the materials in set condition prior to commencement of drying, the drying may be conducted by directing large volumes of hot dry air at the coating. If the coating were to be still in liquid form when the drying is performed, the uniformity of thickness of the coating, achieved at the time of coating, would be destroyed. By setting the coating prior to drying, the uniformity of thickness is maintained through the drying stage.

Chilling has to be conducted in a manner which does not destroy the uniformity of thickness of the coated layer of liquid materials. This is achieved by withdrawing heat from the liquid materials through the web by passing the coated web across chilled rollers in contact with the non-coated side of the web. As is described in U.S. Pat. No. 4,231,164 issued to Eugene H. Barbee on Nov. 4, 1980, the web may be additionally chilled by chilled air directed at its non-coated side, which chilled air also contacts the rollers and serves to chill them. The web is kept in contact with the rollers and is caused to wrap around them for about 20°–45° by a pressure differential on the two surfaces of the coated web. The atmosphere impinging on the coated surface of the web, when the coated web is passing across the chilled rollers, is chilled but its velocity at all places must be so low that air which contacts the liquid coating does not disturb it.

It is desirable to chill the liquid coating rapidly, both to reduce the time during which the coating is still liquid on the web and to reduce the capital and running costs of the chilling zone. One way to increase the rate of chilling of the liquid coating is to lower the temperatures of the impinging atmosphere and chilled rollers right from the beginning of the chilling zone. However, a problem has been encountered when endeavoring to lower the temperatures at the beginning of the chilling zone. This problem is condensation. Atmosphere entering the chilling zone may have a dew point above the temperature in the chilling zone. For example, if the atmosphere outside the chilling zone has a dew point of 8° to 10° C. there will be condensation when such atmosphere meets −4° C. air in the chilling zone. Some of the condensation will land on the coating and cause unacceptable blemishes in the finished product. Also, condensation will accumulate on conveyance means in the chilling zone and such accumulation will interfere with its proper function.

The problem is exacerbated as the dew point of atmosphere travelling with the coated web into the chilling zone increases. Recently there has been a proposal to form an enclosure around the coating station and to raise the pressure of the atmosphere in the enclosure to supra-atmospheric so that drafts and air-borne dust are excluded from the vicinity of the coating station. It is very undesirable to have drafts around the coating station, particularly, but not exclusively, when the coating is performed by the process known as curtain coating. Therefore, atmosphere in the recently proposed enclosure is changed, albeit very slowly by means of a slow downwards and uniform flow of air inside the enclosure. However, the rate of change of atmosphere in the enclosure is such that the dew point increases above that found outside the enclosure, because of moisture evaporation from the coating liquids in the enclosure. The air flow cannot be fast enough to keep the dew point in the enclosure below values ambient outside the enclosure.

Thus, the adoption of such an enclosure, while solving dust and draft related problems, does increase the likelihood of condensation in the upstream end of the chilling zone because the pressure in the enclosure is supra-atmospheric and because the dew point is higher than ambient. Of course, in fulfilling the desire to keep the duration between coating and setting to a minimum, it is desirable to locate the chilling zone as close as possible to the coating station, which further exacerbates the problem.

It is an object of the present invention to solve the problem of condensation in the upstream end of the chilling zone.

SUMMARY OF THE INVENTION

The object of the present invention is achieved by providing isolation means between the coating station and the chilling zone for ensuring that the dew point of any atmosphere travelling with the coated web into the upstream end of the chilling zone is below the temperature it encounters in the upstream end of the chilling zone.

DESCRIPTION OF THE PREFERRED EMBODIMENT

Figure 1:
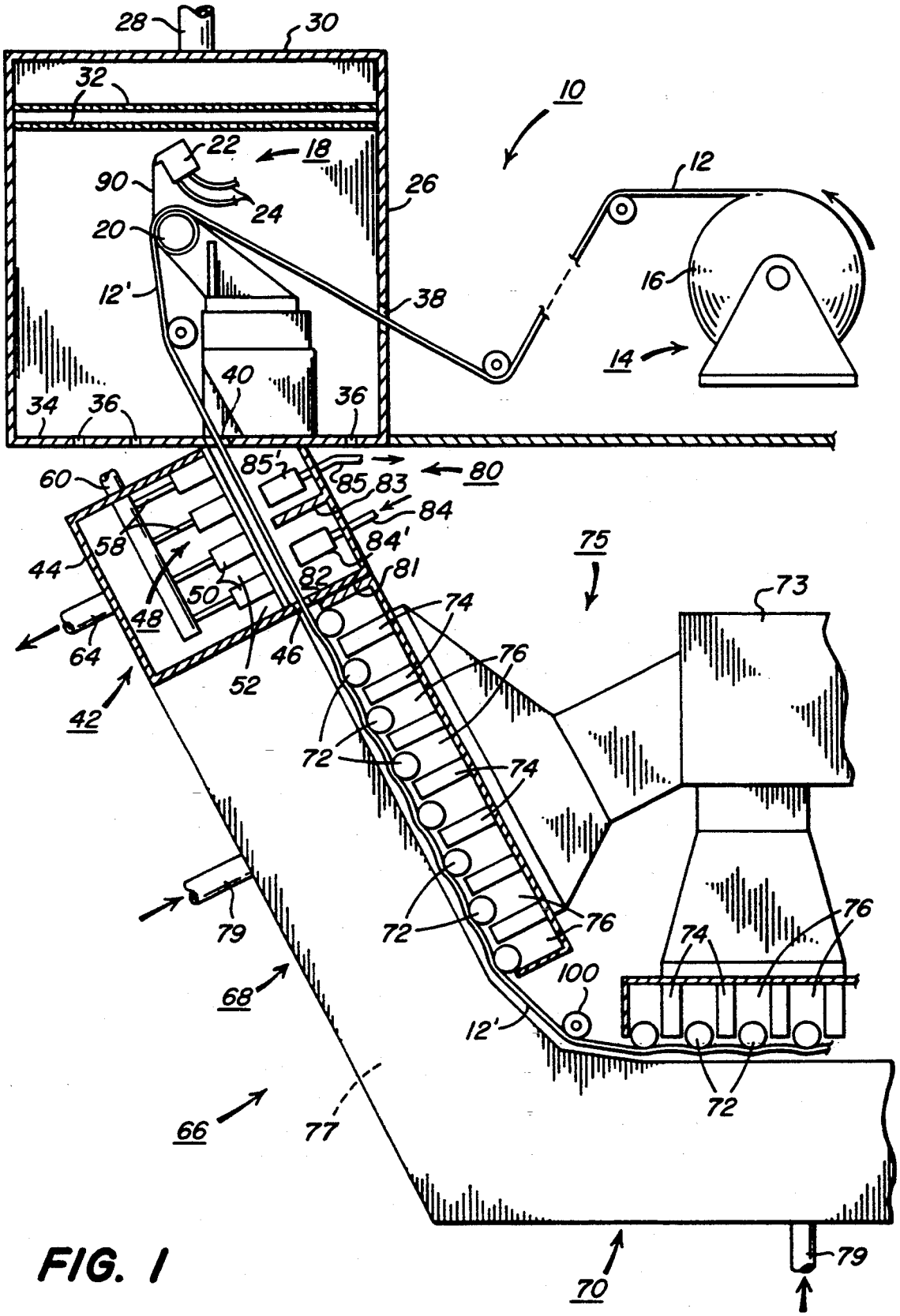
FIG. 1 is a schematic representation of part of apparatus for coating a continuous web with materials, in accordance with the present invention.

A preferred embodiment of the present invention is illustrated in FIG. 1 and includes apparatus 10 for coating photographic materials onto a web 12 of transparent cellulose acetate film, which, after further processing operations will be cut into strips for use as photographic film.

The apparatus 10 includes an unwinder station 14 at which a supply roll 16 of continuous, wound up cellulose acetate web 12 is mounted for controlled unwinding and supply to operations performed in the remainder of the apparatus 10.

The apparatus also includes a coating station 18 at which liquid materials are applied to the web 12. The coating station 18 includes a support roller 20 which forms means for accurately positioning the web for receipt of the liquid materials. In the present embodiment, the liquid materials are applied by curtain coating and, for this purpose, a slide hopper 22 is disposed above the support roller 20, in known relationship. Liquid materials are supplied to the hopper 22 through pipes 24.

The coating station 18 is disposed within an enclosure 26. The enclosure 26 is supplied with air through a duct 28 extending from its ceiling 30. Below the ceiling 30 there are means for ensuring that the flow of air downwards in the enclosure is uniform and laminar across the enclosure. Such means takes the form of a HEPA filter 32, but may take any other known form of device for achieving the purpose such as a plurality of parallel, stacked, spaced-apart, apertured screens. The floor 34 of the enclosure includes apertures 36 to allow flow of air, introduced through the duct 28, downwardly out of the bottom of the enclosure 26.

The enclosure includes an entrance aperture 38 to allow passage of the web 12 into the enclosure 26 and an exit aperture 40 in the floor 34 of the enclosure for passage of the coated web 12' out of the enclosure 26.

Figure 2:
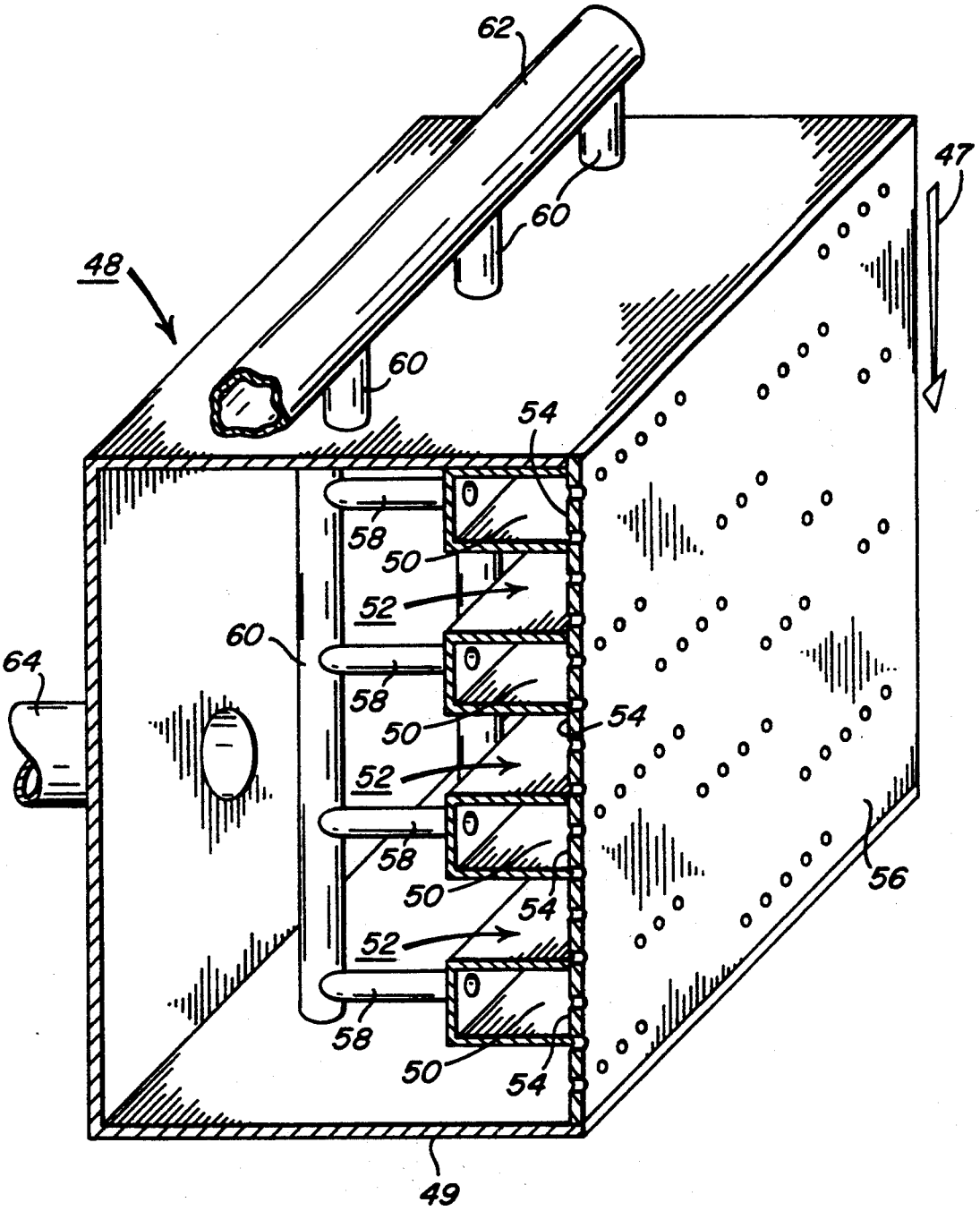
FIG. 2 is a diagrammatic representation of a perspective view, in section, of a component in the apparatus illustrated in FIG. 1.

Contiguous with the underside of the floor 34 of the enclosure 26 is isolation means 42, in accordance with the present invention. The isolation means 42 includes a chamber 44 to which the entrance for the web 12 is formed by the aperture 40 and from which the exit for the web 12' is formed by an aperture 46. Within the chamber 44 of the isolation means 42 there is an air supply and exhaust device 48 which is schematically illustrated in both FIGS. 1 and 2. The device 48 is so constructed as to provide a plurality of spaced apart (in the sense of the direction of web movement past the device, indicated by the arrow 47 in FIG. 2) low velocity flows of air towards the liquid coating on the web, with the flows extending the full width of the web. Between adjacent flows towards the web the air is free to flow away from the web in directions perpendicular to the web. To achieve such flow patterns, a housing 49 (see FIG. 2) is provided within which are disposed a plurality of tubular chambers 50 which are parallel to one another and to the web. The chambers 50 are spaced apart by voids 52. The chambers are open at their sides 54 towards the web. The chambers each have a dimension of 35 mm in a direction parallel to the direction of web movement and the voids each have a dimension of about 15 mm in the same direction. A foraminous screen 56 covers the open sides 54 of the chambers and bridges between adjacent chambers 50. Air is supplied to the chambers 50 through ducts 58, 60 and 62. Air flowing away from the web is free to pass through the portions of the screen 56 which overlie the voids 52 into the space within the housing 49 which it leaves through duct 64 in which there is an exhaust fan (not shown).

At the side of the web path remote from the air supply and exhaust device 48 there is a device 80. The device 80 is constructed to blow air against the web and to allow such air to escape. However, in that the surface of the web which it faces and against which it causes air to flow, does not have liquid coating on it, the device 80 may create less gentle air flows than does the device 48. The device 80 includes a housing 81 bounding an enclosed space 82 which is divided by a baffle 83 which extends full width of the web 12' but is spaced from the web. At the side of the baffle 83 away from the coating station 18 there is an inlet duct 84 for supply of low dew point air to a chamber 84' in the enclosed space 82. At the other side of the baffle 83 there is an outlet duct 85 for flow of air out of a chamber 85' in the enclosed space 82. Each of the chambers 84' and 85' is generally similar to one of the chambers 50 and has a screen over its open face towards the web. Low dew point air flows through the duct 84 into chamber 84' and flows out of the chamber 84' through the screen associated therewith. The air flows over and counter current to the web and is constrained to flow close to the web by the baffle, as it flows towards the chamber 85'. The air, now mixed with the high dew point air which was travelling with the web, flows into the chamber 85' and out through the duct 85. Air is drawn through the outlet duct 85 by an exhaust fan (not shown) which controls the pressure in the chamber 82.

Contiguous with the isolation means 42 is a chilling zone 66, only a portion of which is illustrated in FIG. 1. The chilling zone is constructed substantially as described in U.S. Pat. No. 4,231,164 issued on Nov. 4, 1980 to Eugene H. Barbee to which reference is directed for an understanding of the structure and operation, and the disclosure of which is specifically imported herein by reference.

As may be seen in FIG. 1, the chilling zone includes two portions, a first portion 68 which is so oriented that the web path through it is inclined to the vertical and a second portion 70 which is so oriented that the web path through it is substantially horizontal. With such an arrangement the coating on the web may be set with the web moving substantially horizontally and the coating on the underside of the web in accordance with the teachings of U.S. patent application Ser. No. 703,542 filed on the same day as the present application in the names of Eugene H. Barbee, John D. Lang, Gifford J. Lewis and William A. Torpey and with the title Method and Apparatus for Manufacturing Coated Photographic Materials. The disclosure of that application is imported herein by specific reference.

Briefly, the chilling zone 66 includes a plurality of rollers 72 which are spaced apart and have parallel axes. Chilled air is blown onto the non-coated, back side of the web from ducts 74 disposed in the spaces between adjacent rollers 72. The air from the ducts 74 flows over the surfaces of adjacent rollers 72, chilling the rollers as it does so, and into spaces 76 from which it flows to chambers 75 and out of them through ducts 73 which contain return fans (not shown).

The web is maintained in wrapping contact with the rollers 72 by exerting different pressures on the surfaces of the web. The atmosphere in a space 77 within a housing 78 at the coated side of the web 12' is maintained at a pressure relatively greater than the average pressure on the non-coated surface of the web. To achieve this pressure differential both the supply through ducts 79 and the return through ducts 73 are appropriately controlled. The pressure in space 77 is slightly lower than the pressure in the enclosure 26.

The web is moved through the above-described apparatus continuously by web moving means which include the support roller 20 and conveyance means downstream of the chilling zone. A turning roller 100 is provided at the junction of the inclined and substantially horizontal runs of the web 12'.

In operation, the continuous web is continuously unwound from the roll 16 and is led through entrance aperture 38 in the enclosure 26 to the coating station 18. At the coating station 18 the web is wrapped part way around the support roller 20. Liquid materials to be coated on the web in contiguous discrete layers are supplied to the hopper through pipes 24. The liquids leave the hopper as a single layer, formed of discrete contiguous layers, in the form of a falling curtain 90. The liquid materials in the curtain impinge on the web 12 where it is wrapped about, and positioned by, the support roller 20. The liquid materials form a layer, formed of a plurality of contiguous, overlying discrete layers, of uniform thickness.

Air at the temperature of the liquid materials is being supplied to the enclosure 26 and is passing through the apertured screens 32 which cause it to flow downwards through the enclosure 26 with a low velocity, for example 5 m per minute, which is substantially uniform and laminar throughout the horizontal cross-section of the enclosure. By having a low velocity which is uniform within the enclosure, air currents are avoided which could disturb the curtain or cause differential evaporation from, and differential cooling of, the liquid materials.

The liquid materials on the hopper, in the curtain and on the web give off some moisture which raises the dew point of the air in the enclosure.

The air supplied to the enclosure 26 leaves the enclosure through the apertures 36 and the exit aperture 40 for the web 12', as well as through the web entry aperture 38. Typically the exiting air has been found to have a temperature of 40° C. and a dew point of 8°–10° C.

Air is being supplied to the space 77 in the housing 78 of the chilling zone 66 at a temperature of −4° C. Such a temperature is lower than the dew point of the atmosphere travelling with the web 12' through the exit aperture 40 from the enclosure 26. If such air travelling with the web were to be allowed to enter the chilling zone 66 there would be condensation. If condensate were to land on the coating of liquid materials on the web, defects would be caused. Furthermore, condensate on equipment could cause damage to the product and/or the equipment.

In accordance with the present invention, the problem of condensation in the chilling zone is overcome by the provision and use of the isolation means 42. Air at 24° C. and −9° C. dew point is supplied through ducts 62, 60, 58 to the chambers 50 from which it flows through the foraminous screen 56. The air leaving the foraminous screen flows as gentle streams, having a substantially uniform velocity of about 20 m per minute, towards the uniform thickness layer of liquid materials on the web 12'. Such a velocity is low enough that it does not disturb the liquid materials. The air flows mix with and dilute and generally displace the air travelling with the web. The mixed air passes back through the screen 56 to flow into the voids and thence out through duct 64. The plurality of air flows towards and away from the web may be regarded as progressively washing away the atmosphere which was travelling with the web, replacing it with an atmosphere having a dew point below that in the space 77. The plurality of flows of air ensure that moisture which entered the isolation means through the aperture 40 does not pass on into the chilling zone 66. Any atmosphere which does travel with the web into the chilling zone 66 has a dew point which is lower than the temperature of the air and equipment in the chilling zone. The high dew point air travelling with the web at the back side, that is the non-coated surface, of the web is also washed away and isolated from the chilling zone by the dry air washing process occurring by virtue of the air supplied through duct 84 and exhausted from chamber 82 in housing 81 through duct 85, after flowing between the baffle 83 and the web 12'.

The web 12' with liquid materials thereon passes from the isolation means 42, accompanied by air having a dew point of less than −4° C., into the upstream end of the chilling zone 66 wherein the temperature is −4° C. Thus, as the dew point of the air entering with the web is below the temperature in the chilling zone, there is no condensation.

It will be recognized by those skilled in the art that the temperature in the chilling zone is lower than usual. By virtue of the isolation means, the chilling zone may be run at such low temperature without risk of condensation. By operating at such lower temperature, the rate of cooling of the liquid materials is increased and hence the time between coating at the coating station and setting in the chilling zone, is reduced. Such reduction in time is advantageous because there is less time for flow of the liquid materials relative to the web and because capital costs of the equipment, especially of the chilling zone, and running costs of the chilling zone, are reduced.

An additional benefit of an isolation means in which air is directed at substantially uniform low velocity at the liquid coating, has been discovered. It has been found that the uniformity of thickness of the liquid materials is better than if the web had merely traveled through space in the factory environment between the coating station and the chilling zone. This improved thickness uniformity is attributable to the highly controlled air flow patterns through which the coating on the web passes, as opposed to the random air currents and temperatures encountered in the uncontrolled factory environment.

Figure 3:
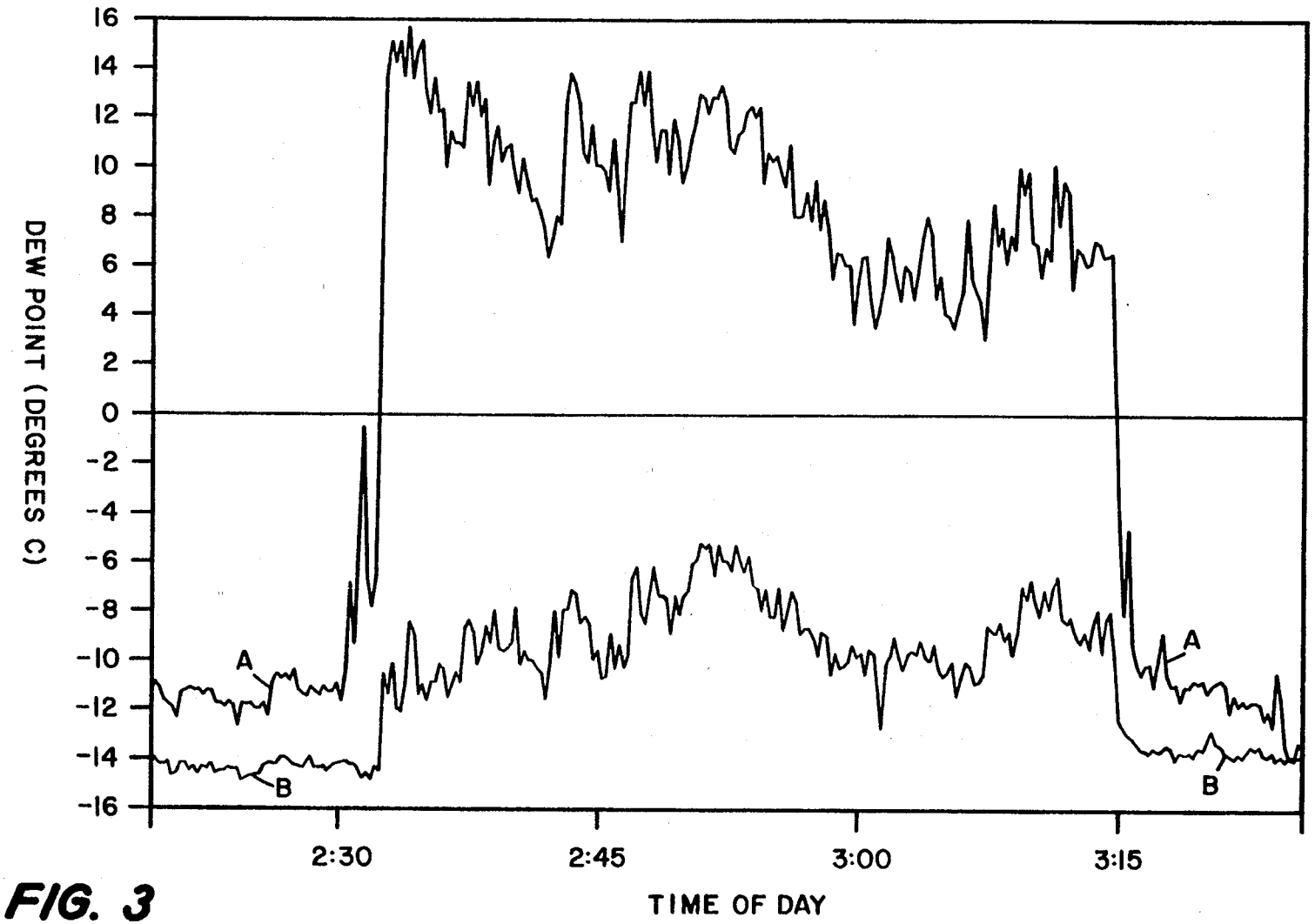
FIG. 3 shows plots of dew point against time for air entering and air leaving the isolation means in the apparatus illustrated in FIGS. 1 and 2.

FIG. 3 illustrates plots of dew point at progressive times for: (plot A) air travelling with the web from the coating station; and (plot B) for air travelling with the web into the chilling zone. It will be seen that the dew point of the air entering the chilling zone is below the temperature, −4° C., of the air and equipment in the chilling zone. It is to be understood that during the times before about 2:30 and after about 3:15 when the dew point of the air leaving the coating station is below that of the air leaving the isolation zone and entering the chilling station no coating was being made.

Figure 4:
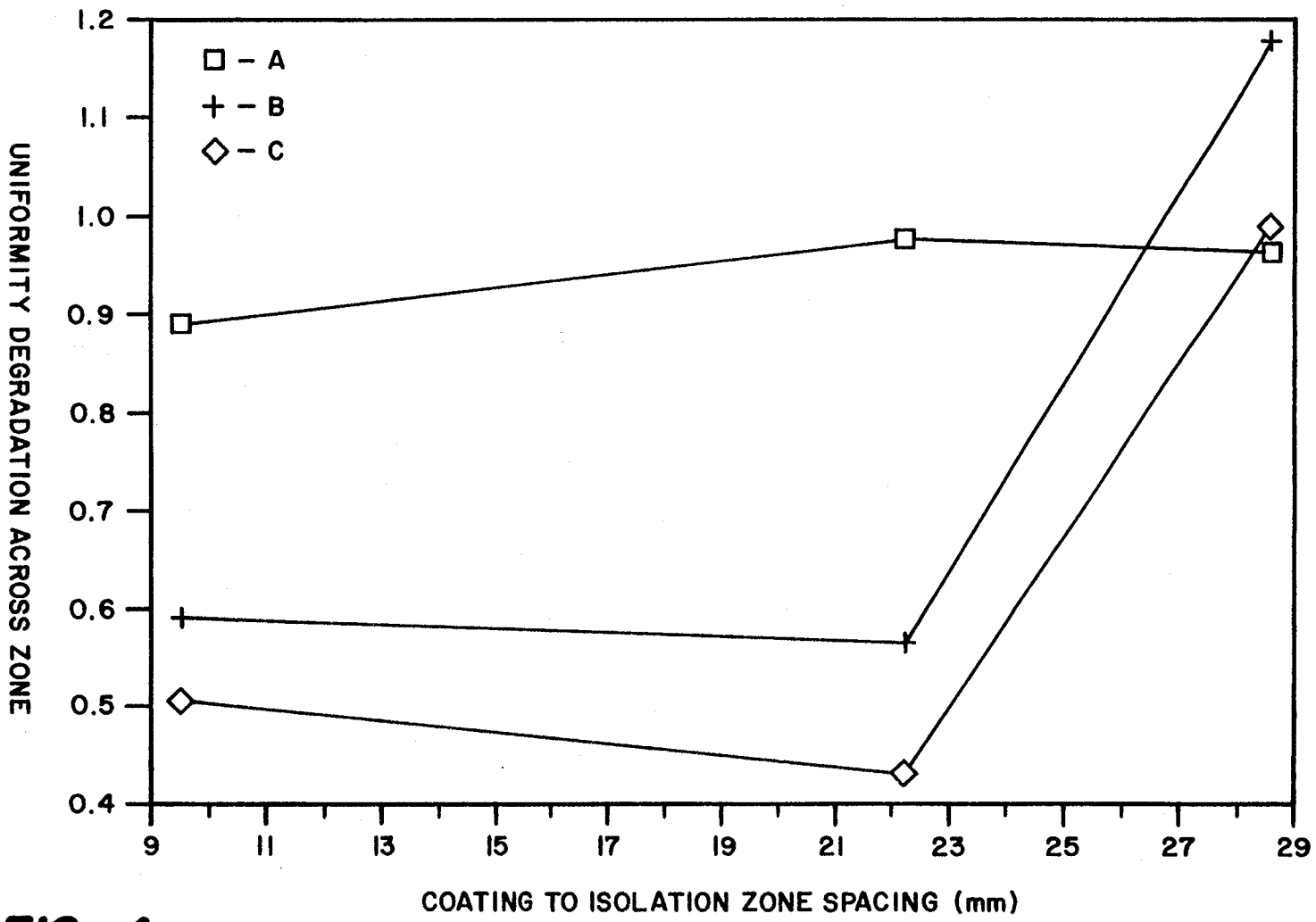
FIG. 4 shows plots of uniformity degradation of the thickness of the coating across the width of the coating against the spacing of the isolation means from the coating on the web.

FIG. 4 demonstrates the additional advantage, mentioned above, that the liquid coating has better thickness uniformity when subjected to the above-described treatment in the isolation means than if it had just traveled through space in the factory environment in that time. FIG. 4 is a plot of degradation in coating uniformity, in arbitrary units (the lower the value, the better being the uniformity), against spacing of the liquid coating from the foraminous screen 56. The data was taken at a web speed of 30 m per minute with a bottom layer thickness of 0.1 mm. Plot A results from a test in which no air was flowed through the isolation means. Plot B results from an air flow lower than that of plot C. It will be observed that coating thickness uniformity improves with increasing air flow and increasing distance between the liquid coating and the foraminous screen 56, but then deteriorates with increasing distance at least within the ranges of parameters tested.

One particular form of the isolation means has been described above. It will be understood by those skilled in the art that other forms of isolation means may be adopted which also serve to prevent air having a dew point higher than the temperature at the upstream end of the chilling zone, from entering the chilling zone.

It will also be understood that even if the coating station is not so constructed that there is an increase in the dew point of the air passing with the coated web away from it, adoption of the invention has advantages if the ambient air around the web just prior to its entry into the chilling zone has a dew point higher than the temperature in the upstream end of the chilling zone.

It is also to be understood that while the invention has been described in an embodiment which coats the web by slide hopper curtain coating, the invention may also be used with benefit in embodiments in which the web is coated in other ways, such as, for example, slide hopper bead coating or extrusion coating.

While in the embodiment particularly described above, the web being coated is formed of cellulose acetate, it is to be understood that the web may be formed of other materials, such as, for example, paper or polyethylene terephthalate.

The invention has been described in detail with particular reference to the preferred embodiments thereof, but it is to be understood that variations and modifications can be effected within the spirit and scope of the invention.

What is claimed is:

1. Apparatus for coating a continuous web with liquid photographic materials, comprising:

means for supplying a continuous web continuously;

a coating station including means for positioning the continuous web and means for applying a layer of the liquid materials in liquid form to the web positioned by positioning means;

a chilling zone in which the liquid materials on the web are chilled and having an upstream end at which the coated web enters the chilling zone;

isolation means between said coating station and said chilling zone and contiguous with said coating station and said chilling zone for ensuring that atmosphere traveling with the coated web into the chilling zone has a dew point below the temperature it encounters in the upstream end of said chilling zone said isolation means comprising:

a first plurality of parallel spaced apart ducts;

a second plurality of parallel spaced apart ducts adjacent said first plurality of spaced apart ducts;

means for supplying air to said first plurality of spaced apart ducts wherein said first plurality of ducts direct air towards the continuous web;

means for withdrawing air through said second plurality of spaced apart ducts wherein said second plurality of ducts withdraws air away from the continuous web, the air being directed and withdrawn at such a velocity to ensure that liquid materials on the continuous web are undisturbed; and means for moving the continuous web continuously through said coating station, said isolation means and said chilling zone.

2. Apparatus as claimed in claim 1 wherein said isolated zone includes:

a housing including an entrance adapted to allow the web to enter the housing and an exit adapted to allow the web to leave the housing and enter said chilling zone.

3. Apparatus as claimed in any one of the preceding claims, including:

an enclosure, said coating station being disposed in said enclosure;

means for supplying air to an upper region of said enclosure;

means for exhausting air from a lower region of said enclosure; and wherein:

said isolation means is contiguous with said enclosure and said chilling zone.

4. The apparatus according to claim 1 further comprising:

a foraminous screen positioned over said first and second pluralities of spaced apart ducts.

* * * * *